US006393790B1

(12) United States Patent
Fisher

(10) Patent No.: US 6,393,790 B1
(45) Date of Patent: May 28, 2002

(54) CONSTRUCTION BLOCK CAP AND METHOD

(76) Inventor: Myles A. Fisher, 2006 E. Mallory St., Pensacola, FL (US) 32503

( * ) Notice: Subject to any disclaimer, the term of this patent is extended or adjusted under 35 U.S.C. 154(b) by 0 days.

(21) Appl. No.: 09/540,943

(22) Filed: Mar. 31, 2000

(51) Int. Cl.[7] ..... E04C 3/00

(52) U.S. Cl. ..... 52/465; 52/468; 52/469; 52/800.12; 52/800.14; 52/800.15; 52/800.16

(58) Field of Search ..... 52/465, 468, 469, 52/800.12, 800.14, 800.15, 800.17, 306, 308

(56) References Cited

U.S. PATENT DOCUMENTS 4,031,680 A * 6/1977 Stoakes ..... 52/400
4,057,945 A * 11/1977 Kessler ..... 52/398
5,031,372 A * 7/1991 McCluer ..... 52/307
5,277,005 A * 1/1994 Hellwig et al. ..... 52/220.1
5,430,985 A * 7/1995 Coleman ..... 52/308
5,448,864 A * 9/1995 Rosamond ..... 52/307
5,904,018 A * 5/1999 Campagnari ..... 52/306
6,223,489 B1 * 5/2001 Fisher ..... 52/308

* cited by examiner

*Primary Examiner*—Carl D. Friedman
*Assistant Examiner*—Christy Green
(74) *Attorney, Agent, or Firm*—Peter Loffler

(57) ABSTRACT

A construction block cap is used to cap the open end of a construction block in order to provide a generally air tight and water tight seal of the open end. The construction block cap has a body member with a top surface and a bottom surface and a raised portion extending upwardly from the top surface in spaced apart fashion with respect to the outer periphery of the body member. The body member is positioned so that the top surface rests on the edges of the open end and the outer surface of the raised portion abuts the interior surfaces of the faces and two of the side edges of the construction block. A channel can be located on the top surface on order to hold a desiccant tube. The bottom surface has a connection system to connect to a frame member, the connection system being either male or female in nature.

21 Claims, 12 Drawing Sheets

CONSTRUCTION BLOCK CAP AND METHOD

BACKGROUND OF THE INVENTION

1. Field of the Invention

The present invention relates to a construction block cap that is used to cap the open end of a construction block in order to provide a generally air tight and water tight seal of the block's open end.

2. Background of the Prior Art

Many windows and other partitions are constructed from a plurality of construction blocks that are interfitted to one another in order to create the window. Typically, each individual block comes in a standard size (e.g. 6 inches or 8 inches) which results in windows of multiples of the standard sizes. However, many applications, such as custom made windows or when retrofitting construction block windows into existing openings, the need arises for a window that is not of a standard size. In order to create such a window, the blocks along an outer edge, either a horizontal edge, a vertical edge, or both are cut in order to achieve the desired window opening dimensions. Unlike the uncut blocks making up the center of the window, the cut blocks at the perimeter do not have an interior that is air tight and water tight. This can result in air penetration and moisture penetration into the interior of the block. This reduces the insulating capacity of the window and can cause the interior of the block to fog up with condensation or have mildew growth therein.

Therefore, it is advantageous to be able to seal the cut block before installation of the window in order to overcome the above-stated problems associated with cut blocks. A device is needed that can achieve such a result. Ideally, the device will be of relatively simple design and construction and will be relatively easy to install.

SUMMARY OF THE INVENTION

The construction block cap and method of the present invention addresses the aforementioned needs in the art. The construction block cap is used to cap the open end of a cut construction block in order to provide a relatively air tight and water tight seal of the open end of the construction block. The construction block cap, when affixed to the cut block's open end, can be easily secured to the frame within which the construction block window pane will be secured either directly or via construction block cap stock.

The construction block cap and method of the present invention comprises a first body member having a top surface, a bottom surface, a left side, a right side, a first end, and a second end. A raised portion extends upwardly from the top surface in spaced apart relation from the left side, the right side, the first end, and the second end. A first channel may be located on the top surface and can be used to hold a desiccant tube. The bottom surface may be relatively flat or means for attachment of the body member to the frame may be located on the bottom surface. Such means for attachment can be either male or female in nature depending on the corresponding nature of the frame. If the means for attachment is female, it comprises a second channel, and optionally a third channel, located on the bottom surface and extending between the first end and the second end and each oriented generally parallel to the left side. If the means for attachment is male, it comprises a first flange, and optionally a second flange, extending along the bottom surface and each oriented generally parallel to the left side. The body member is positioned over the cut away open end of a construction block such that the top surface rests on the cut edges of the block and the raised portion abuts the interior surface of the pair of faces, the first side edge, and the third side edge and is siliconed or otherwise secured in place. If two construction block caps meet at a corner construction block with two side edges removed instead of one, two construction block caps can be appropriately mitered in order to facilitate the required snug abutment of the two construction block caps to one another.

BRIEF DESCRIPTION OF THE DRAWINGS

Similar reference numerals refer to similar parts throughout the several views of the drawings.

DESCRIPTION OF THE PREFERRED EMBODIMENT

Figure 1:
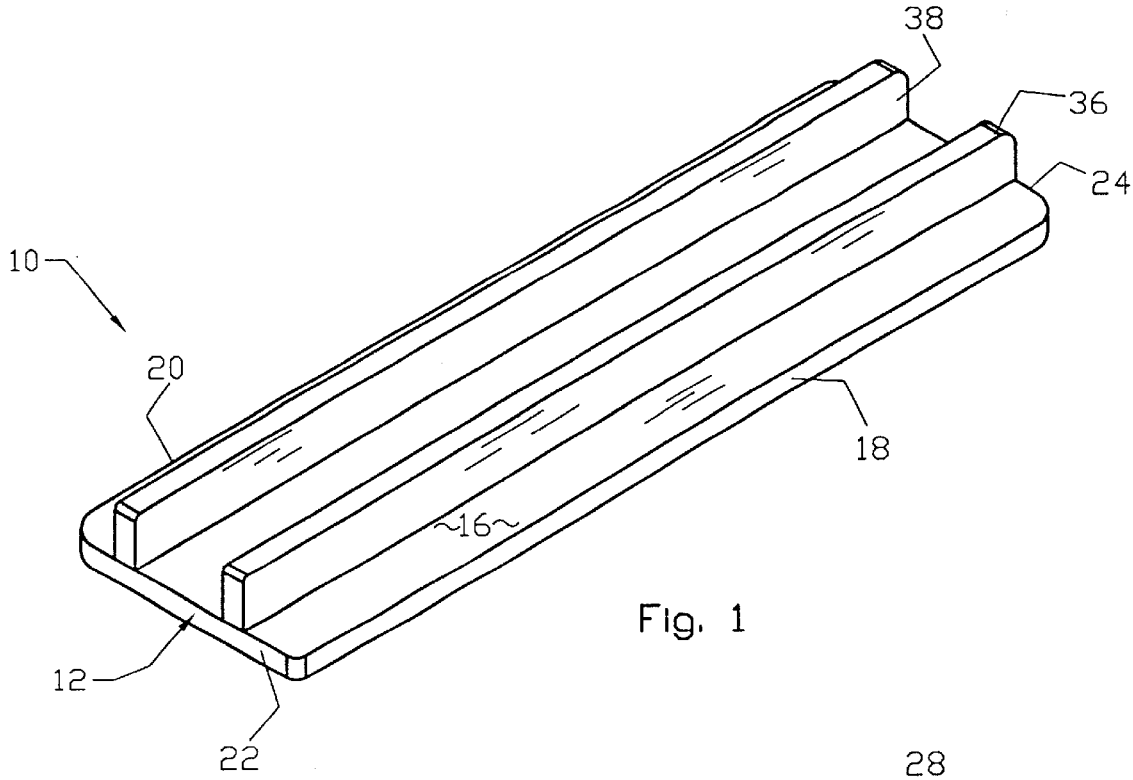
FIG. 1 is a lower perspective view of the construction block cap of the present invention having dual flanges on the bottom surface.
Figure 2:
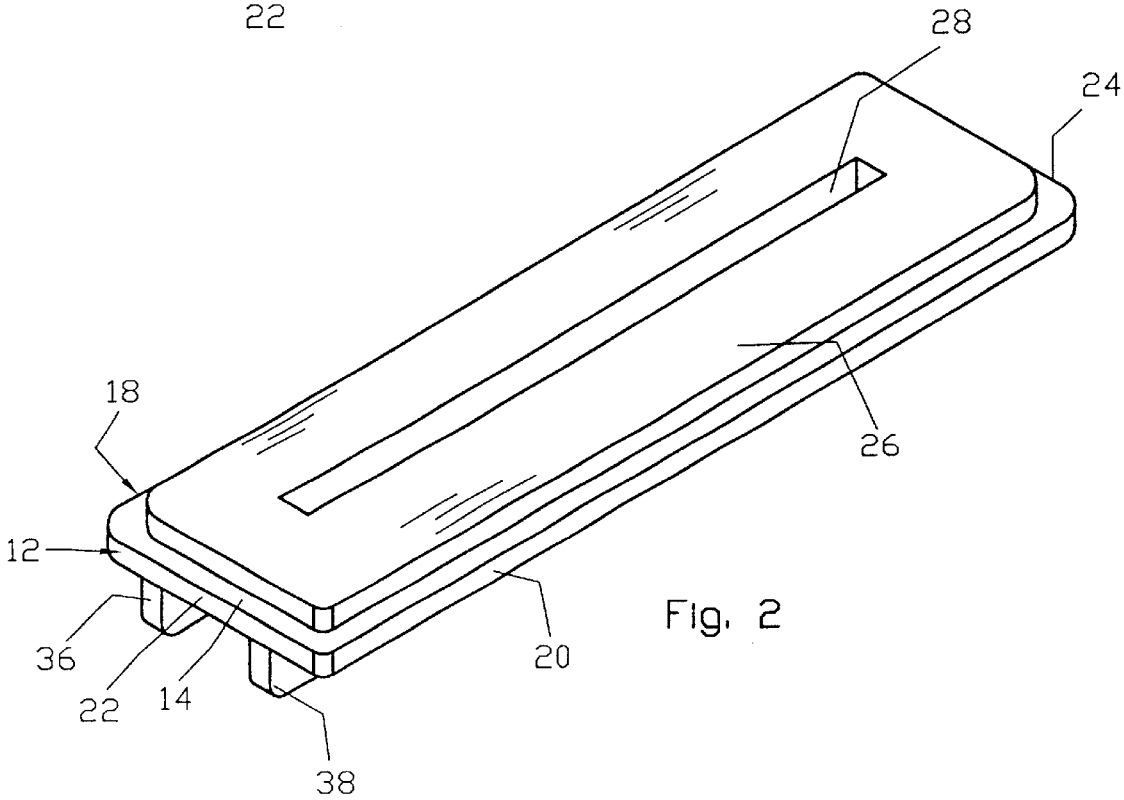
FIG. 2 is an upper perspective view of FIG. 1.
Figure 3:
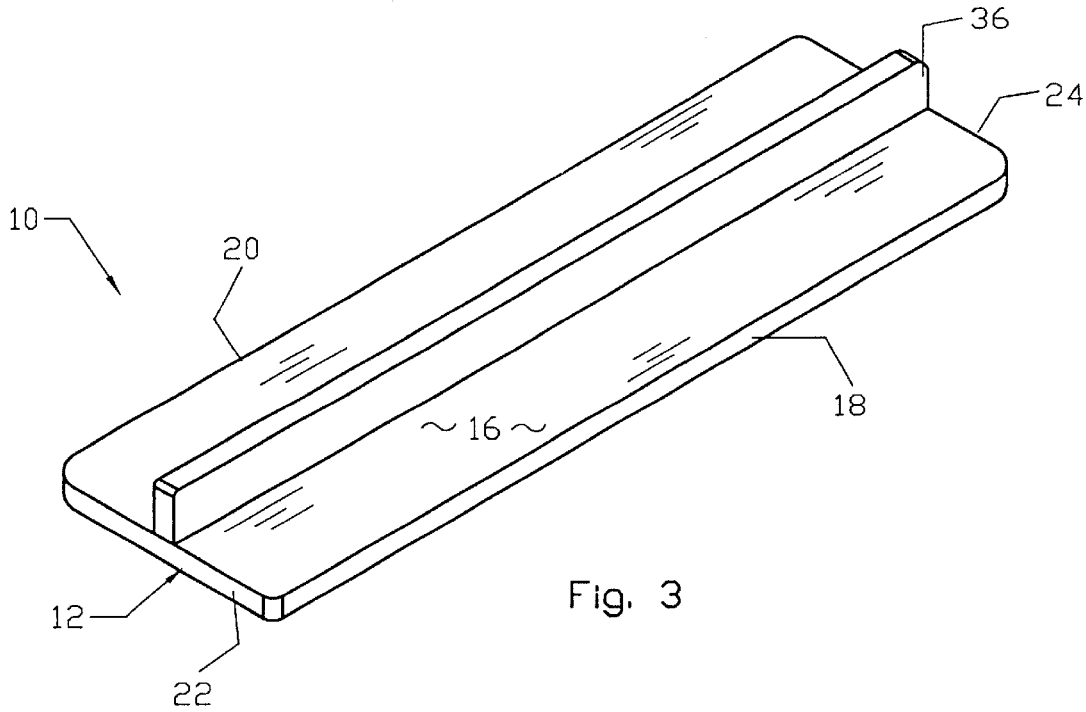
FIG. 3 is a lower perspective view of the construction block cap having a single flange on the bottom surface.
Figure 4:
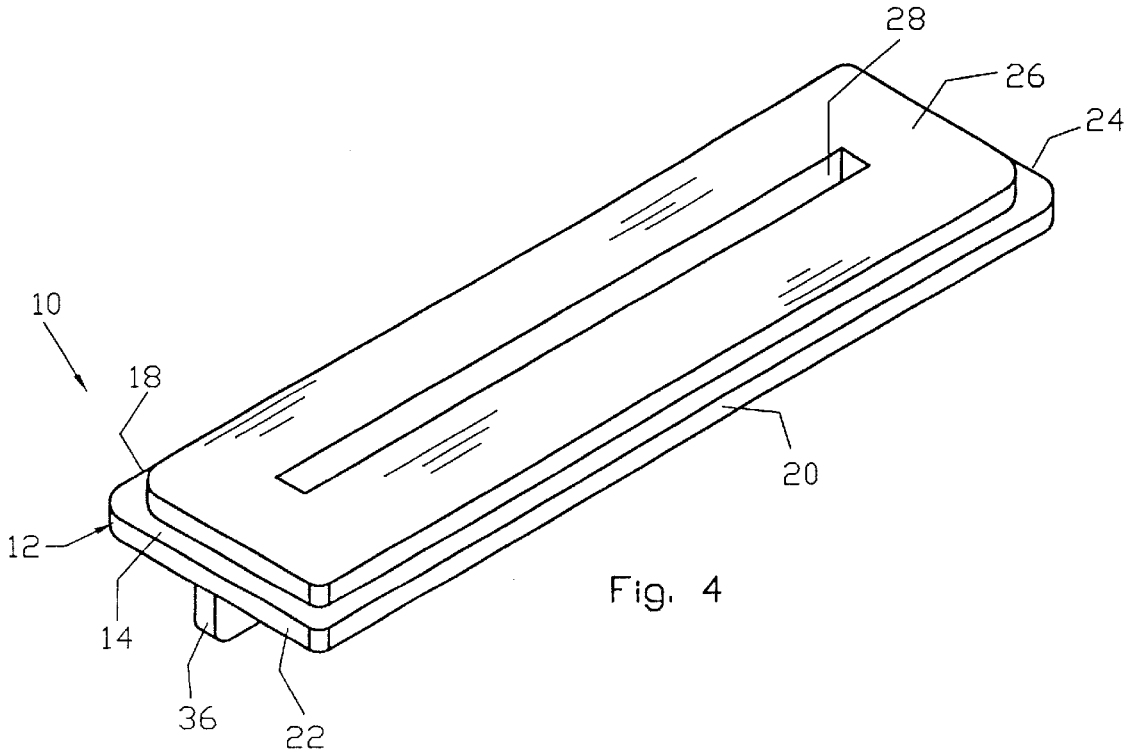
FIG. 4 is an upper perspective view of FIG. 3.
Figure 5:
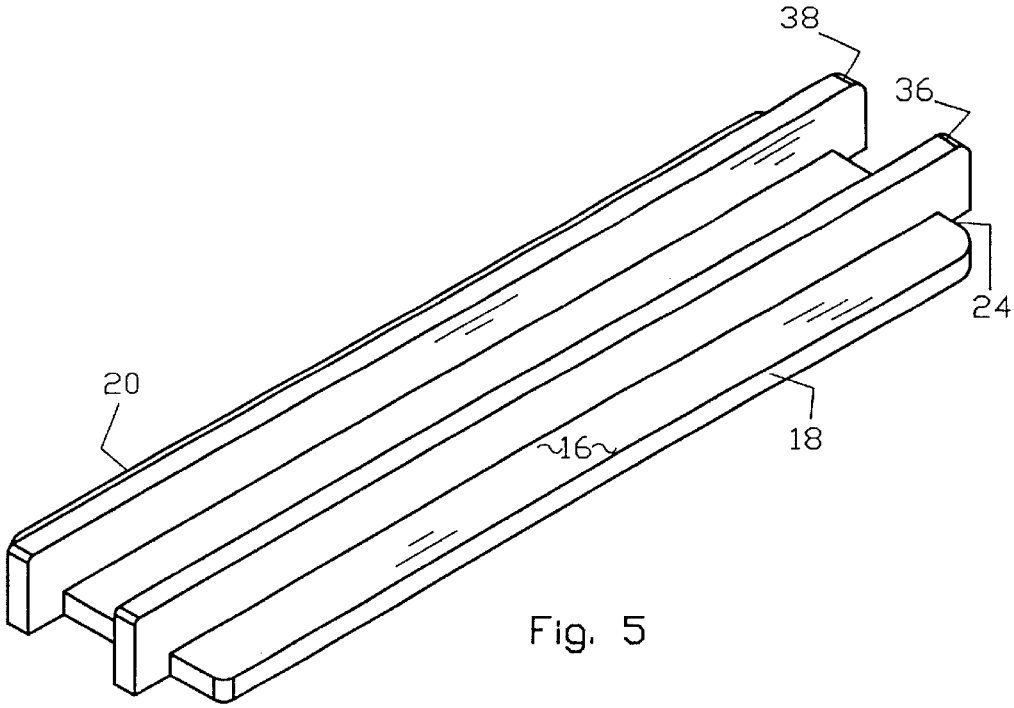
FIG. 5 is a lower perspective view of the construction block cap having flanges on the bottom surface extending beyond the ends.
Figure 6:
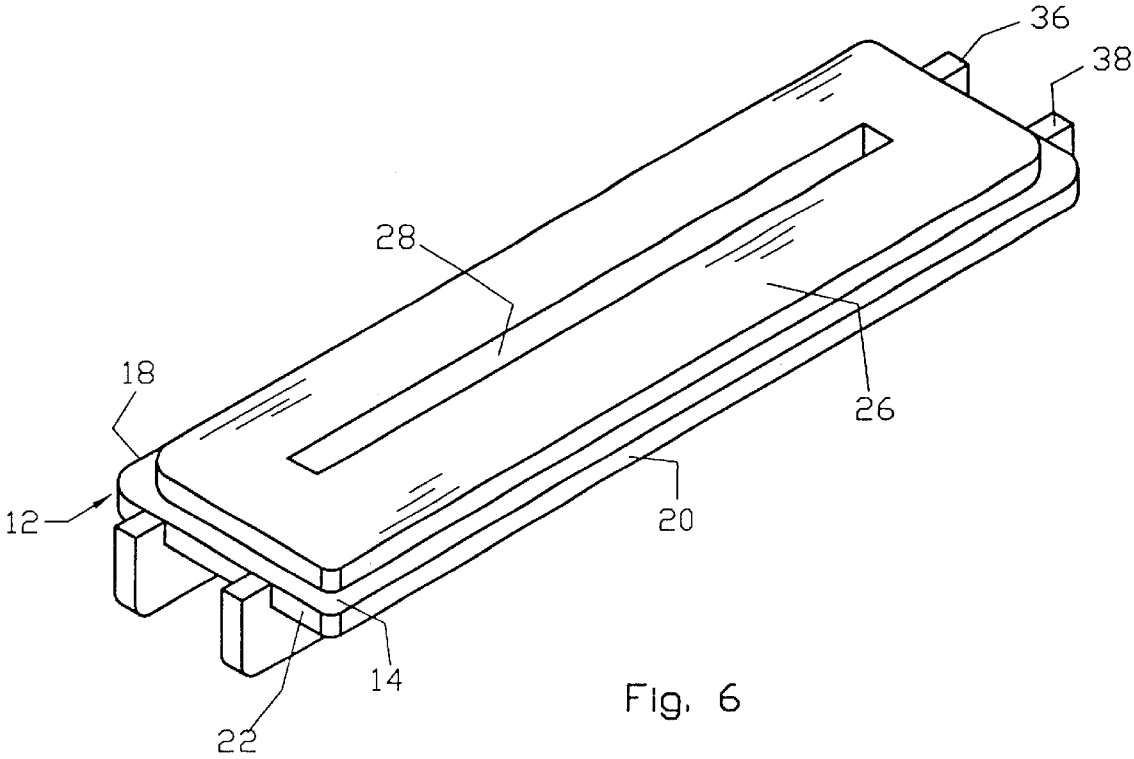
FIG. 6 is an upper perspective view of FIG. 5.
Figure 7:
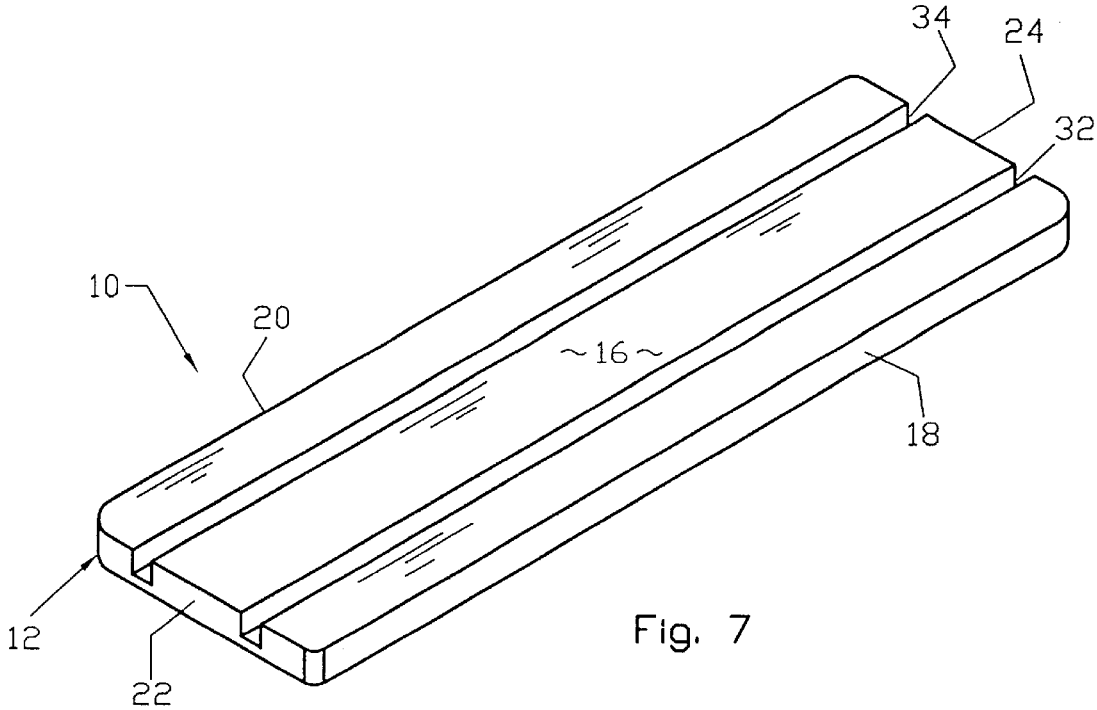
FIG. 7 is a lower perspective view of the construction block cap having dual channels on the bottom surface.
Figure 8:
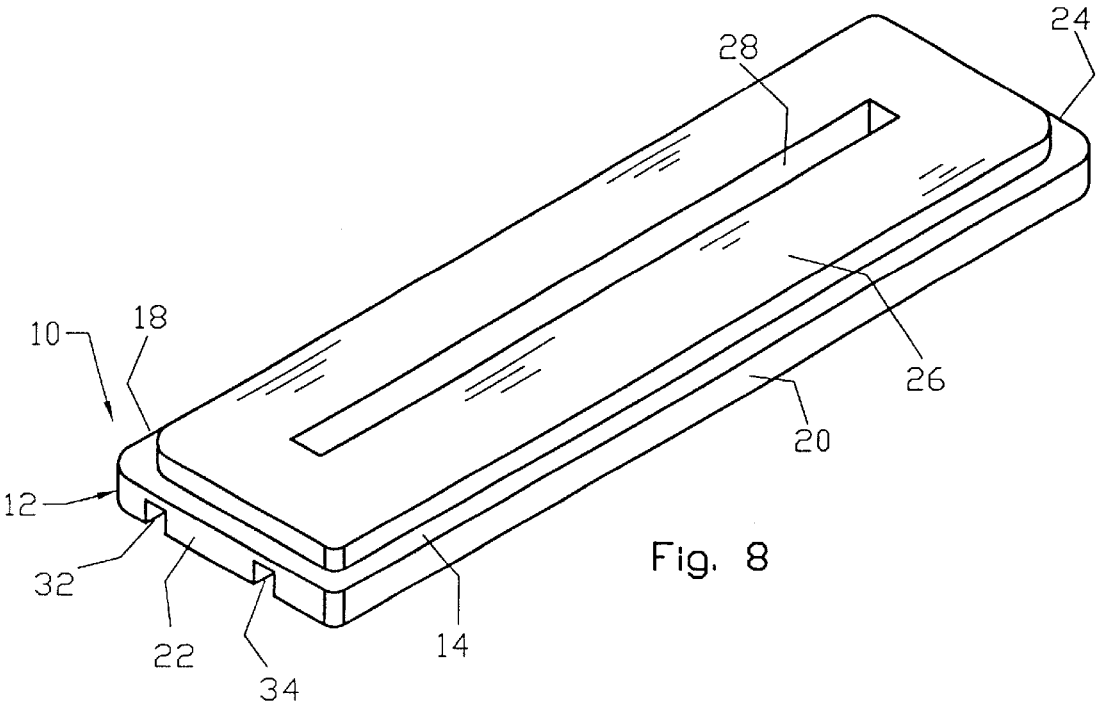
FIG. 8 is an upper perspective view of FIG. 7.
Figure 9:
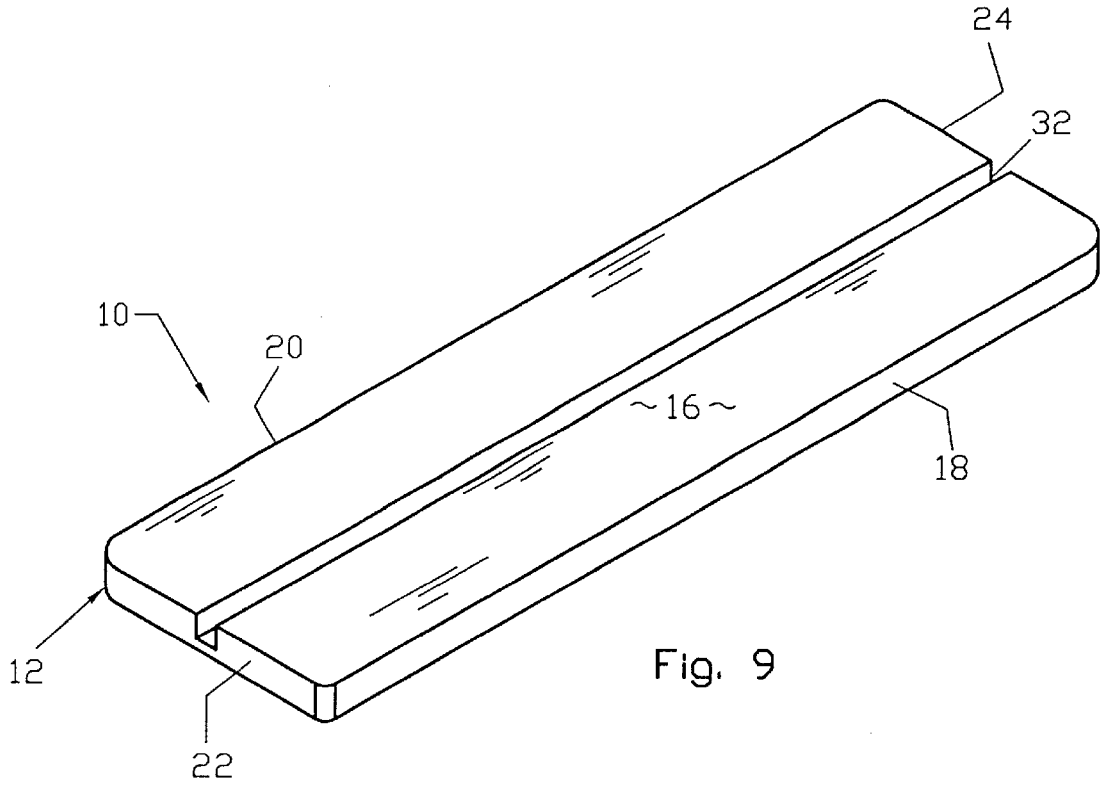
FIG. 9 is a lower perspective view of the construction block cap having a single channel on the bottom surface.
Figure 10:
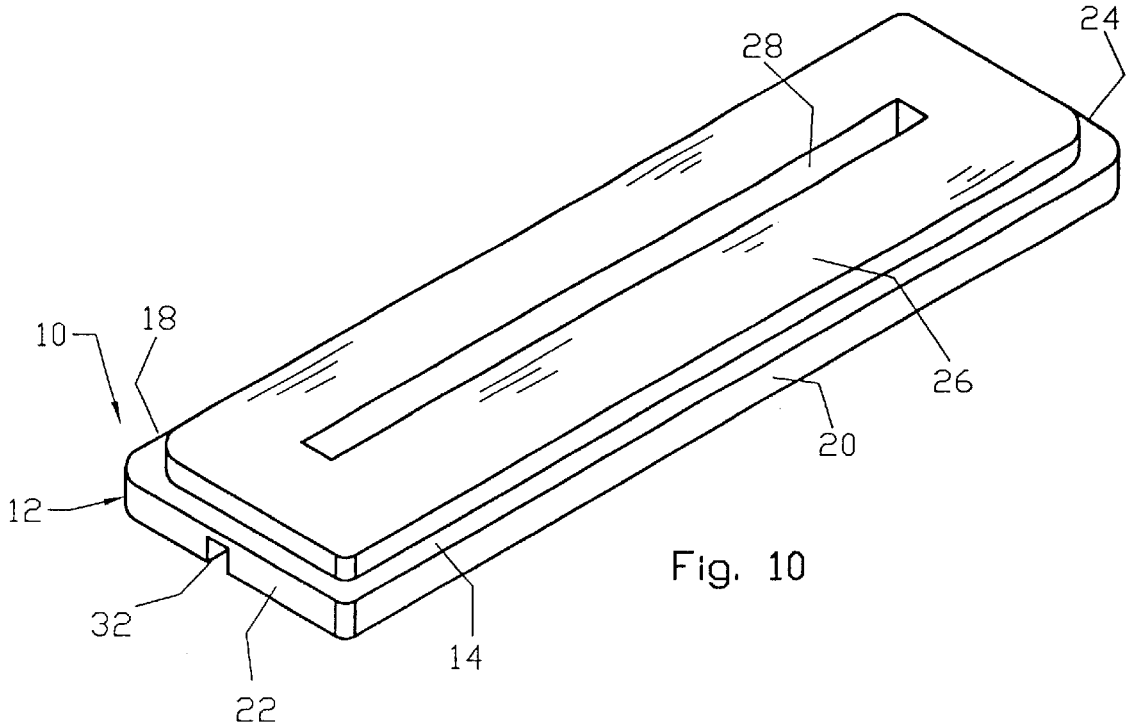
FIG. 10 is an upper perspective view of FIG. 9.
Figure 11:
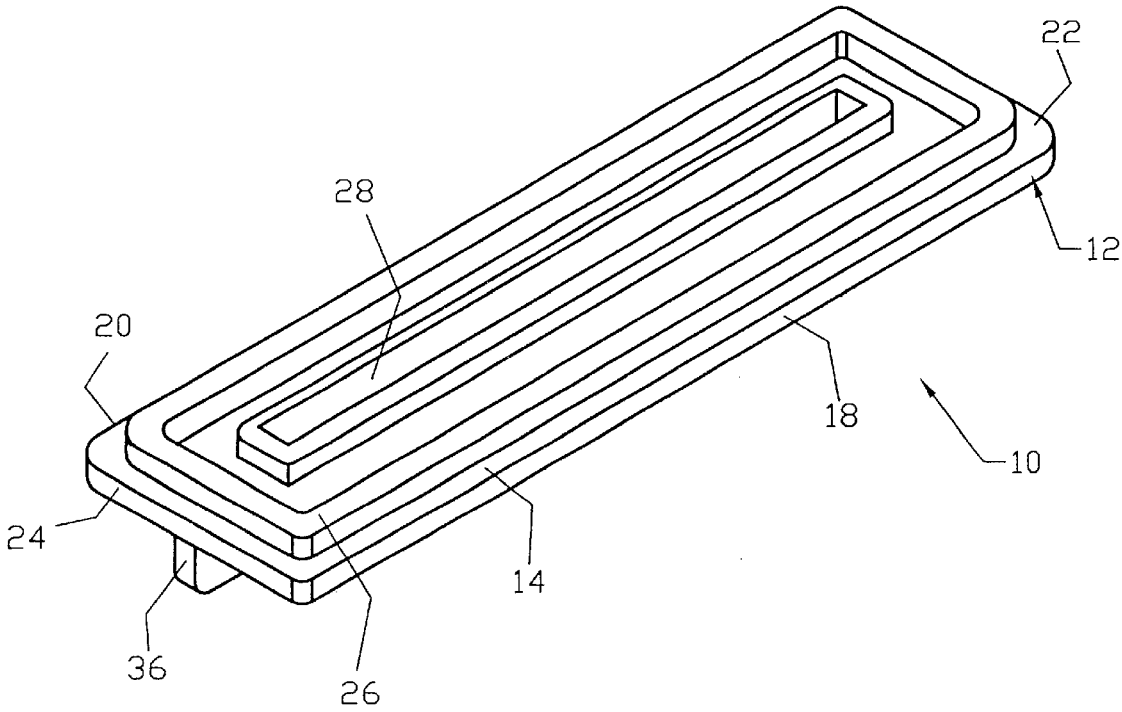
FIG. 11 is an upper perspective view of the construction block cap having a raised portion that is disjoint from the first channel.
Figure 12:
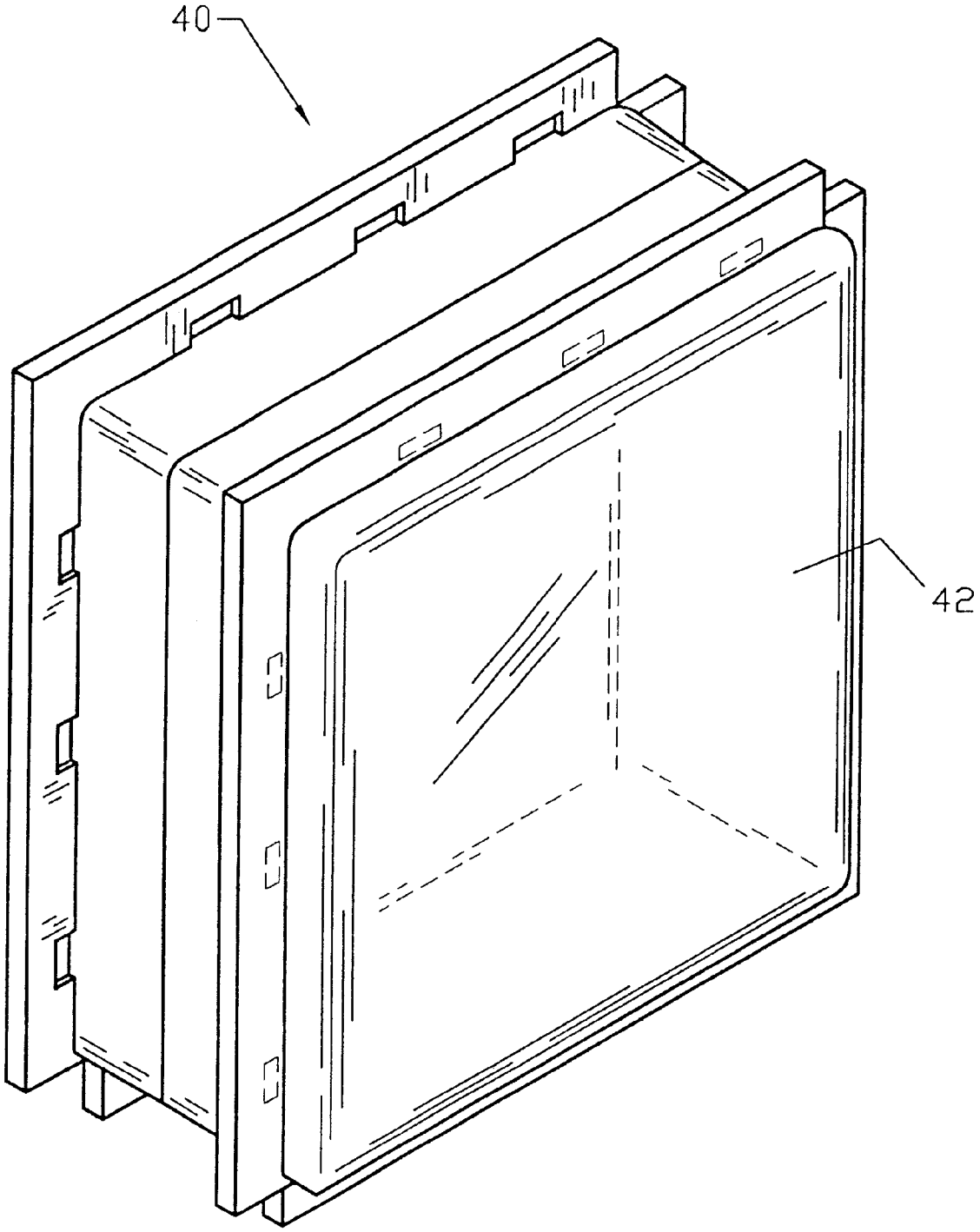
FIG. 12 is a perspective view of a construction block.
Figure 13:
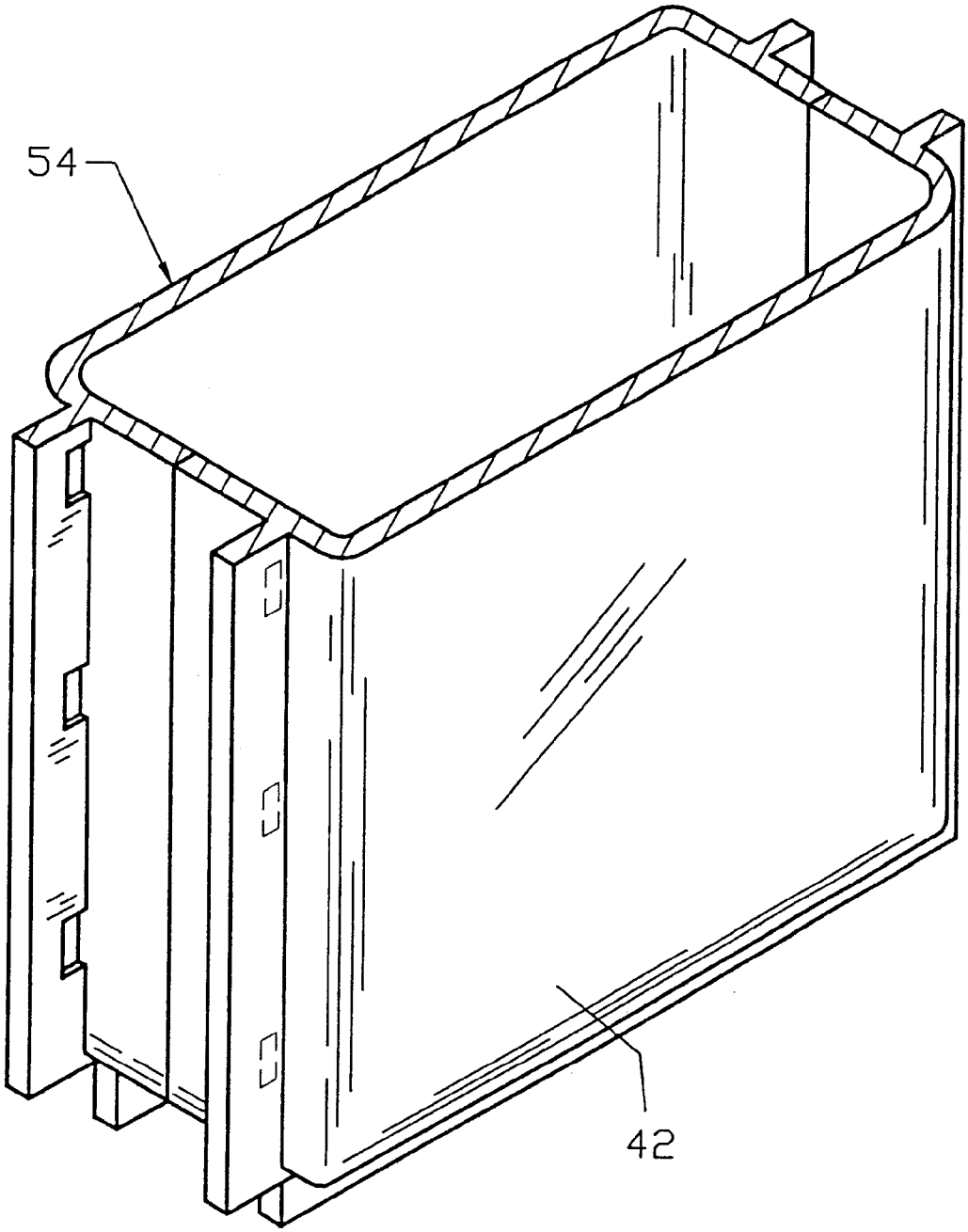
FIG. 13 is a perspective vie of the construction block of FIG. 12 having the 4th side cut away.
Figure 14:
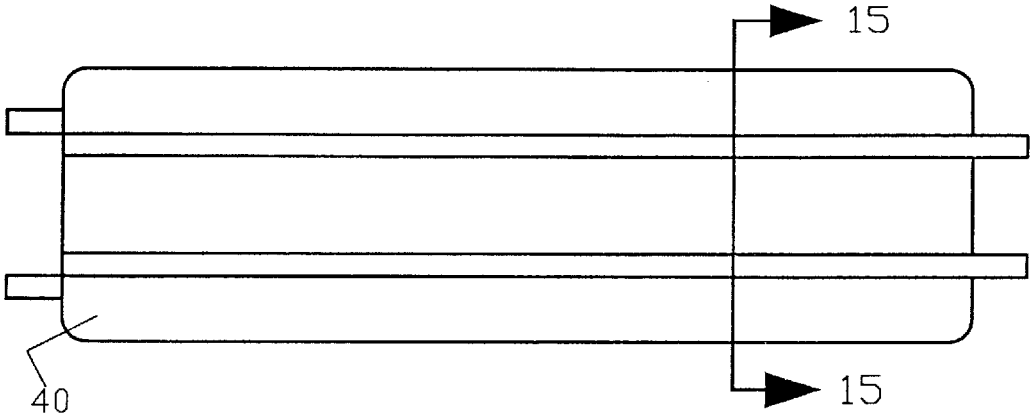
FIG. 14 is a top plan view of the construction block cap attached to a construction block.
Figure 15:
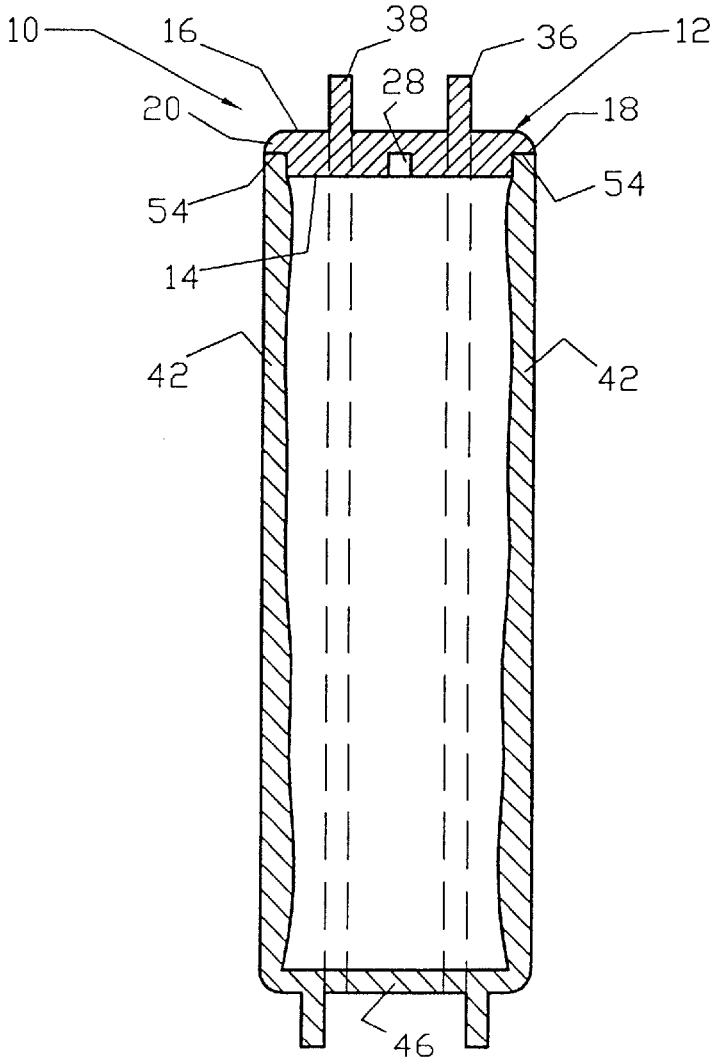
FIG. 15 is a sectioned view taken along line 13—13 in FIG. 12.

Referring now to the drawings, it is seen that the construction block cap and method of the present invention, generally denoted by reference numeral 10, is comprised of a first body member 12 having a top surface 14, a bottom surface 16, a left side 18, a right side 20, a first end 22, a second end 24. A raised portion 26 extends upwardly from the top surface 14 in spaced apart relation from the left side 18, the right side 20, the first end 22, and the second end 24. A first channel 28 may be located on the top surface 14 and can be used to hold a desiccant tube 30. As best seen in FIGS. 2, 4, 6, 8, and 10, the raised portion 26 can be a generally solid member with the first channel 26 formed therein. Alternately, as seen in FIG. 11, the raised portion 26' can be a flange member that encircles the top surface 14 and the first channel 28' is disjoint from the raised portion 26'. The bottom surface 16 may be relatively flat or means for attachment of the body member 12 to the frame F may be located on the bottom surface 16. Such means for attachment can be either male or female in nature depending on the corresponding nature of the frame. If the means for attachment is female, it comprises a second channel 32, and optionally a third channel 34, located on the bottom surface 16 and extending between the first end 22 and the second end 24 and each oriented generally parallel to the left side 18 (or the right side 20). If the means for attachment is male, it comprises a first flange 36, and optionally a second flange 38, extending along the bottom surface 16 and each oriented generally parallel to the left side 18. Each flange 36 and 38 can be generally flush with the first end 22 and the second end 24 of the body member 12 or can extend beyond one or both of the ends 22 and 24. The construction block cap 10 can be made from any suitable material such as vinyl, metal, etc., and may be relatively rigid or relatively flexible.

As seen in FIGS. 12–20, a construction block comprises a second body member 40 that has a pair of faces 42 joined by a first side edge 44, a second side edge 46, a third side edge 48, and a fourth side edge 50. In order to size the construction block 40, the fourth side edge 50 is cut away in order to give the construction block 40 and open end 52 (it being expressly recognized that the construction block can be initially constructed without the fourth side 50 and this an open end 52). The first body member 12 is positioned over the open end 52 of the construction block 40 such that the top surface 14 rests on the cut edges 44 and 48 and the cut edges of the faces 42 of the construction block 40 and the outer faces of the raised portion 26 or 26' abuts the interior surface of the first side edge 44, the third side edge 48, and the inner surface of each of the pair of faces 42. The raised portion 26 or 26' is dimensioned so that the construction block cap 10 nests snugly over the open end 52 and so that very little space exists between the cut construction block 40 and the raised portion 26 or 26'. Silicone 56 or other appropriate adhesive is placed at all points of contact between the construction block cap 10 and construction block 40 in order to secure the construction block cap 10 in place. The silicone assures a generally air tight and water tight seal of the construction block cap 10 to the cut construction block 40.

Figure 17:
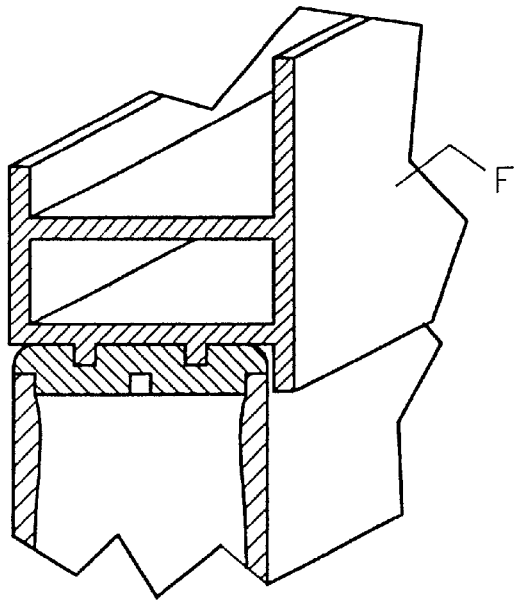
FIG. 17 is a sectioned view of the construction block cap attached to a construction block and secured to the frame.
Figure 16:
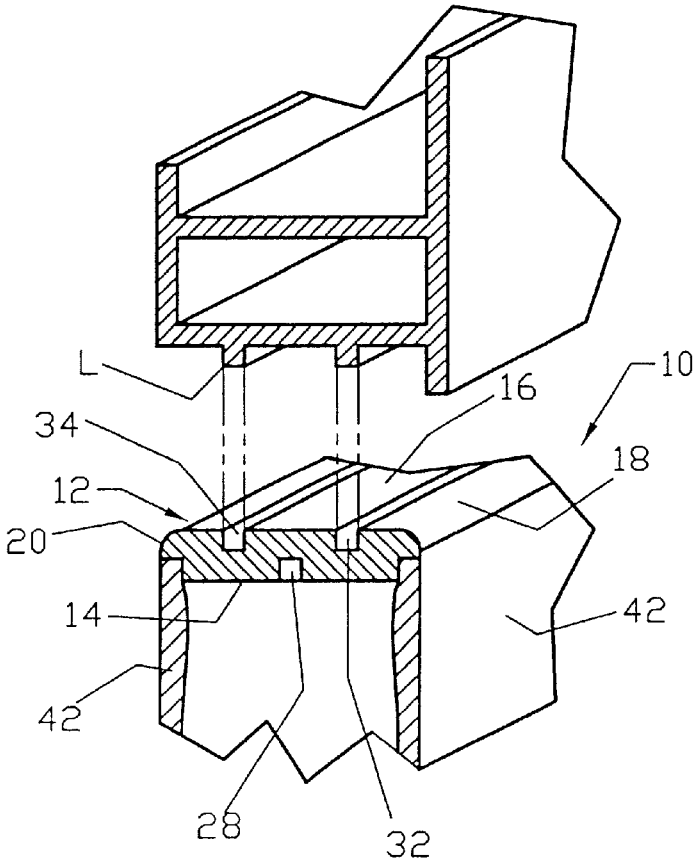
FIG. 16 is a sectioned view of the construction block cap, having female means for attachment to a frame, attached to a construction block prior to being attached to the frame.
Figure 19:
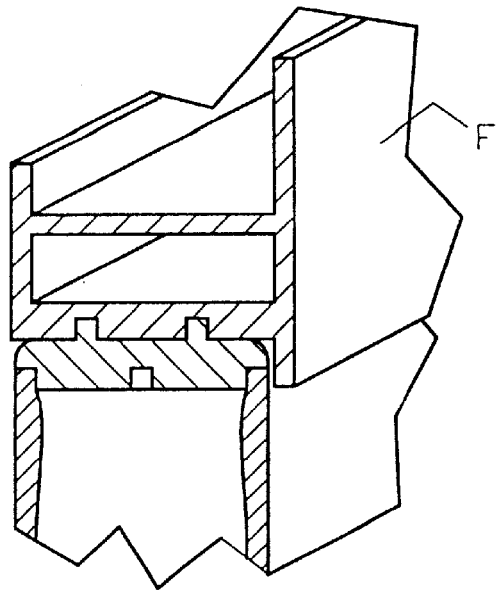
FIG. 19 is a sectioned view of the construction block cap attached to a construction block and secured to the frame.
Figure 18:
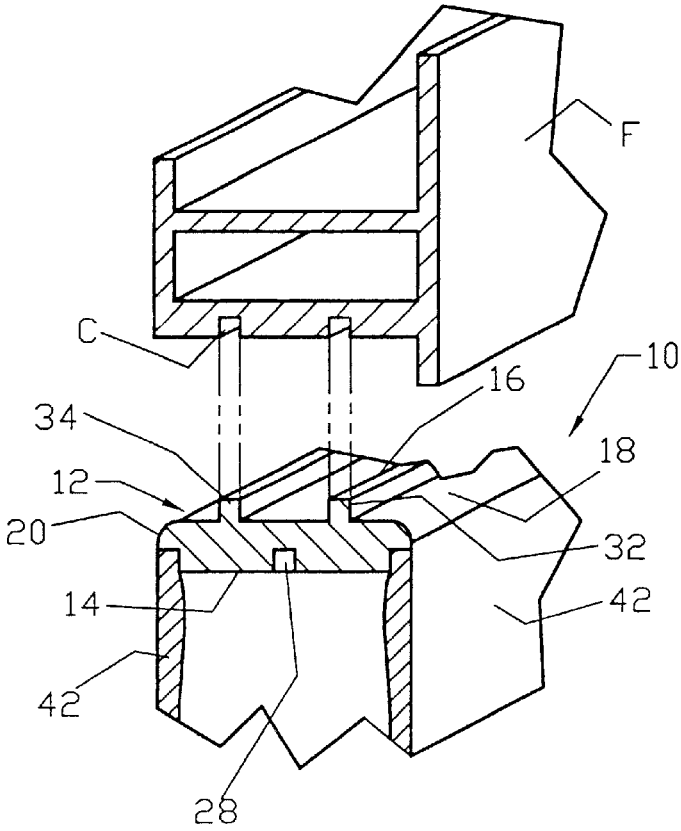
FIG. 18 is a sectioned view of the construction block cap, having male means for attachment to a frame, attached to a construction block prior to being attached to the frame.
Figure 20:
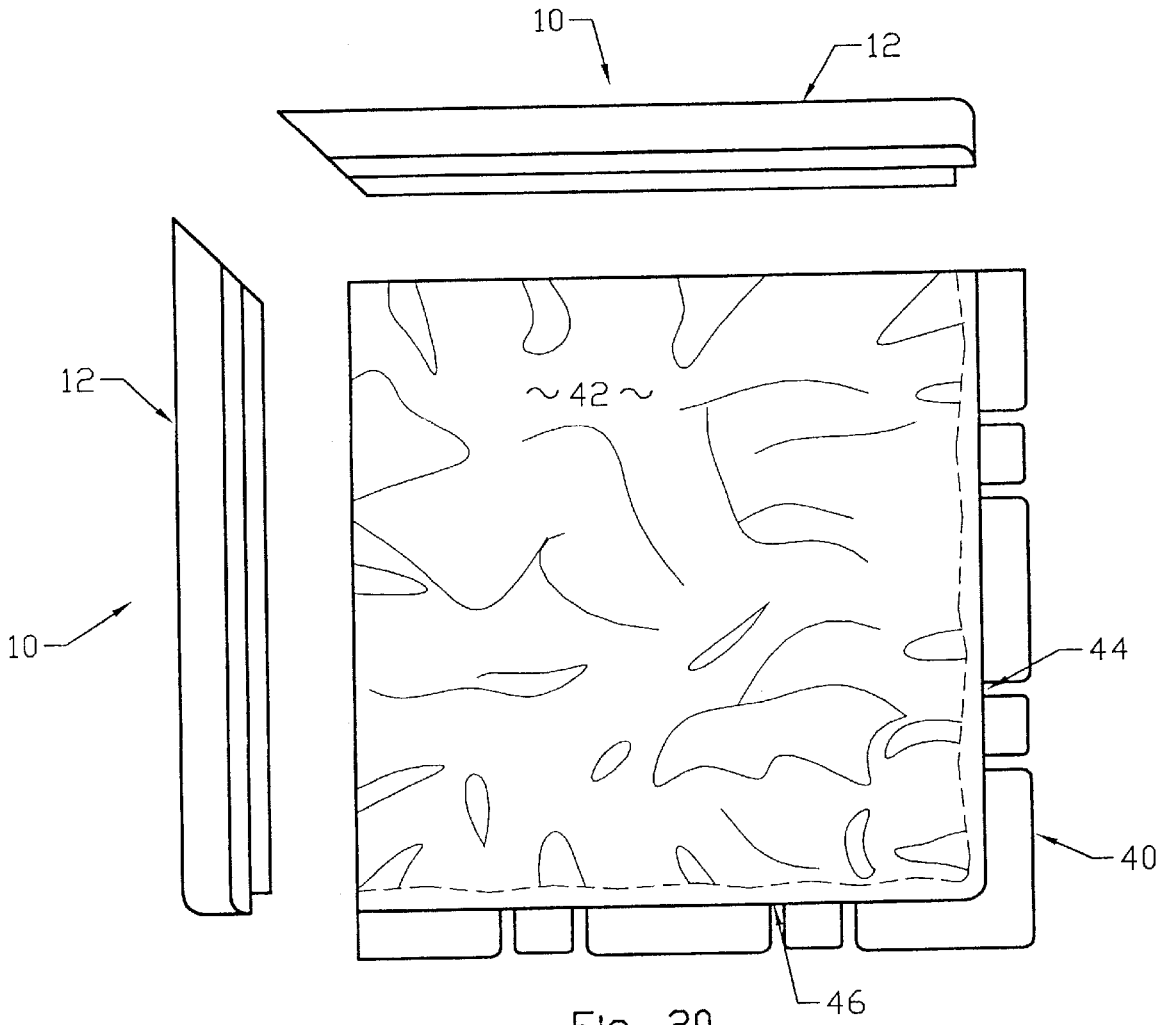
FIG. 20 is a front elevation view of a pair of mitered construction block caps prior to being attached to a corner construction block.
Figure 21:
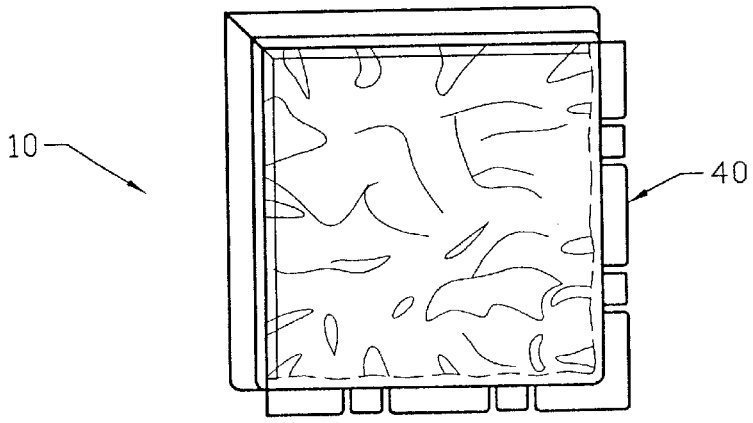
FIG. 21 is a front elevation view of the pair of mitered construction block caps attached to a comer construction block.

If two construction block caps 10 meet at a corner construction block 40 that has had two sides cut away instead of one, each construction block cap 10 can be appropriately mitered in order to facilitate snug abutment of the two construction block caps 10 to one another, as seen in FIGS. 16 and 17.

If the cut on the construction block 40 is other than a generally level cut (such as an arcuate cut), the construction block 40 will need to be made from a resilient material so that the construction block cap 10 can conform to the shape of the cut.

Once all construction block caps 10 are in place on their respective construction blocks 40, the entire construction block structure may be positioned in the frame F (which may be a sub-frame that itself fits within a frame). Flanges L on the frame F are received within the second channel xx and the third channel xx (if used) in order to facilitate joinder of the construction block structure to the frame F. Alternately, the first flange 36 and the second flange 38 (if used) are received within channels C located on the frame F.

While the invention has been particularly shown and described with reference to an embodiment thereof, it will be appreciated by those skilled in the art that various changes in form and detail may be made without departing from the spirit and scope of the invention.

I claim:

1. An outer periphery construction block cap, in combination with a construction block, the construction block comprising a body formed from a resinous material, the body formed by a pair of face portions with inwardly directed side portions, edge portions of the side portions in abutting relationship and joined by a welded or adhesive seam defining an interior chamber, the construction block also having an open end leading into the interior chamber, the construction block cap comprising:

a first body member having a top surface, a bottom surface, a left side, a right side, a first end, and a second end;

a raised portion extending upwardly from the top surface in spaced apart relation from the left side, the right side, the first end, and the second end; and wherein the first body member positioned over the open end of the construction block such that the top surface rests on the open end and the raised portion abuts the pair of faces.

2. The construction block cap as in claim 1 further comprising a channel located on the top surface.

3. The construction block cap as in claim 2 further comprising a desiccant disposed within the channel.

4. The construction block cap as in claim 1 further comprising a first channel located on the bottom surface and extending between the first end and the second end and oriented generally parallel to the left side.

5. The construction block cap as in claim 4 further comprising a second channel located on the bottom surface and extending between the first end and the second end and oriented generally parallel to the first channel.

6. The construction block cap as in claim 1 further comprising a first flange extending along the bottom surface and oriented generally parallel to the left side.

7. The construction block cap as in claim 6 further comprising a second flange extending along the bottom surface and oriented generally parallel to the second flange.

8. The construction block cap as in claim 1 further comprising means for attachment of the body member to a frame, located on the bottom surface.

9. The construction block cap as in claim 8 wherein the means for attachment comprises a second channel disposed within the bottom surface and extending between the first end and the second end and oriented generally parallel to the left side.

10. The construction block cap as in claim 8 wherein the means for attachment comprises a flange extending along the bottom surface and oriented generally parallel to the left side.

11. A method for securement of a construction block cap comprising the steps of:

providing a construction block, the construction block comprising a first body formed from a resinous material, the body formed by a pair of face portions with inwardly directed side portions, edge portions of the side portions in abutting relationship and joined by a welded or adhesive seam defining an interior chamber, the construction block also having an open end leading into the interior chamber;

providing a second body member having a top surface, a bottom surface, a left side, a right side, a first end, a second end, a raised portion extending upwardly from the top surface in spaced apart relation from the left side, the right side, the first end, and the second end; and securing the second body member over the open end such that the second body member is positioned over the open end such that the top surface rests on the open end and the raised portion abuts the pair of faces.

12. The method as in claim 11 further comprising the step of locating a channel within the top surface.

13. The method as in claim 12 further comprising the step of disposing a desiccant within the channel.

14. The method as in claim 12 further comprising the step of locating a first channel within the bottom surface and extending between the first end and the second end and oriented generally parallel to the left side.

15. The method as in claim 13 further comprising the step of locating a second channel within the bottom surface and extending between the first end and the second end and oriented generally parallel to the first channel.

16. The method as in claim 11 further comprising the step of extending a first flange along the bottom surface and oriented generally parallel to the left side.

17. The method as in claim 16 further comprising the step of extending a second flange along the bottom surface and oriented generally parallel to the second flange.

18. The method as in claim 11 further comprising the step of providing means for attachment of the body member to a frame, located on the bottom surface.

19. The method as in claim 18 wherein the means for attachment comprises a second channel disposed within the bottom surface and extending between the first end and the second end and oriented generally parallel to the left side.

20. The method as in claim 18 wherein the means for attachment comprises a flange extending along the bottom surface and oriented generally parallel to the left side.

21. The method as in claim 11 further comprising the step of mitering the first end of the second body member.

* * * * *